US007954289B2

(12) United States Patent
Evans

(10) Patent No.: US 7,954,289 B2
(45) Date of Patent: Jun. 7, 2011

(54) ANCHORING SYSTEM FOR POSTS

(75) Inventor: Dean Richard Evans, Waitakere City (NZ)

(73) Assignee: Nok Lok Licensing Limited, Auckland (AU)

( * ) Notice: Subject to any disclaimer, the term of this patent is extended or adjusted under 35 U.S.C. 154(b) by 0 days.

(21) Appl. No.: 12/129,620

(22) Filed: May 29, 2008

(65) Prior Publication Data

US 2009/0025332 A1 Jan. 29, 2009

Related U.S. Application Data

(63) Continuation of application No. PCT/NZ2006/000314, filed on Dec. 1, 2006.

(30) Foreign Application Priority Data

Dec. 1, 2005 (NZ) ..... 543906

(51) Int. Cl.
*E02D 27/42* (2006.01)

(52) U.S. Cl. ..... 52/298; 52/745.21; 52/40; 52/155; 52/292; 248/530; 403/109.5; 403/314; 403/374.1; 405/249; 405/258.1

(58) Field of Classification Search ..... 52/40, 297, 52/298, 169.13, 170, 159, 155, 165, 296, 52/223.13; 248/548, 256, 530, 545, 523; 256/65.14; 403/109.5, 297, 314, 374.1, 374.2, 403/374.3, 374.4; 405/249, 258.1, 259.1, 405/259.4

See application file for complete search history.

(56) References Cited

U.S. PATENT DOCUMENTS

| | | | | | |
|---|---|---|---|---|---|
| 1,033,447 | A | * | 7/1912 | Mower | 411/60.2 |
| 1,421,398 | A | * | 7/1922 | Burchess | 248/523 |
| 1,856,000 | A | * | 4/1932 | Smith | 47/40.5 |
| 2,713,327 | A | * | 7/1955 | West | 119/790 |
| 3,250,170 | A | * | 5/1966 | Siegel | 411/53 |
| 3,385,565 | A | * | 5/1968 | Cuthbert | 256/13.1 |
| 3,612,287 | A | * | 10/1971 | Maltese | 52/298 |
| 3,952,377 | A | * | 4/1976 | Morell | 24/136 R |
| 4,261,138 | A | * | 4/1981 | St. George Syms | 47/40.5 |
| 4,744,691 | A | * | 5/1988 | Thal | 403/374.2 |
| 4,793,110 | A | * | 12/1988 | Tucker | 52/297 |
| 5,157,882 | A | * | 10/1992 | Soble | 52/298 |
| 5,497,972 | A | * | 3/1996 | Sofy | 248/523 |
| 5,566,926 | A | * | 10/1996 | Voigt | 256/13.1 |
| 5,571,229 | A | | 11/1996 | Fitzsimmons et al. | |
| 5,752,349 | A | | 5/1998 | Fitzsimmons et al. | |

(Continued)

FOREIGN PATENT DOCUMENTS

| | | |
|---|---|---|
| WO | WO 92/20889 | 11/1992 |

(Continued)

*Primary Examiner* — Robert J Canfield
*Assistant Examiner* — Matthew J Gitlin
(74) *Attorney, Agent, or Firm* — Knobbe Martens Olson & Bear LLP

(57) ABSTRACT

An anchoring system to lock posts into housings mounted in the ground, or to lock pipes into housings within holes through walls or foundations uses plastic collets to match post outer profiles to inner housing profiles. The collets have two gently tapered circumferential areas which lock into corresponding tapered areas in the housing. Keys help to lock the post into the collet and in turn into the housing. Customized collets match incompatible posts and housings. The anchored post may be released for re-use, with a security release system that requires the use of special tools.

24 Claims, 18 Drawing Sheets

U.S. PATENT DOCUMENTS

| | | | | |
|---|---|---|---|---|
| 5,791,824 | A * | 8/1998 | Radtke | 405/259.5 |
| 5,797,963 | A * | 8/1998 | McDevitt | 606/232 |
| 6,050,034 | A * | 4/2000 | Krinner | 52/155 |
| 6,267,688 | B1 * | 7/2001 | Morelli, Sr. | 473/179 |
| 6,287,044 | B1 * | 9/2001 | Huber | 403/297 |
| 6,450,745 | B2 * | 9/2002 | Wieser | 411/58 |
| 6,684,585 | B2 * | 2/2004 | Campbell | 52/223.13 |
| 7,147,404 | B2 * | 12/2006 | Spearing et al. | 405/259.5 |
| 2003/0121223 | A1 * | 7/2003 | Riker | 52/296 |
| 2005/0082826 | A1 | 4/2005 | Werth | |

FOREIGN PATENT DOCUMENTS

| | | |
|---|---|---|
| WO | WO 99/24672 | 5/1999 |
| WO | WO 00/39402 | 7/2000 |

* cited by examiner

ANCHORING SYSTEM FOR POSTS

CROSS REFERENCE TO RELATED APPLICATIONS

This application is a continuation of International Application PCT/NZ2006/000314, filed on Dec. 1, 2006.

BACKGROUND OF THE INVENTION

1. Field of the Invention

This invention relates to a re-usable support structure for a pole, post, mast or other elongate member; the basis of which is a reversibly lockable ground anchor to be inserted in the ground or other substrate.

2. Description of the Related Art

A wide variety of activities depend on the temporary placement of poles in the ground or in a flat floor, road or other substrate, to serve a purpose for a defined period and then to be removed until needed again. Applications include road signs and traffic control measures, advertising or information signs, fences for animal control or crowd control, posts for use when playing sports, tent poles, Christmas tree supports, poles/posts for carrying utility wires, and the like. The invention is more particularly applicable to those activities that require repeated placement, removal, and replacement of poles in or near the same place and where in the absence of the pole the area should be free of obstruction.

Past solutions to this need include: providing posts with heavy laterally spread-out bases that sit upon the ground, forcing posts into the ground so that they are held by friction against the ground around the lowest part of the post, embedding posts into concrete, ice, or some other material which can set around the base of the post, and/or making use of mechanical gripping devices such as keys, wedges, or collets.

Despite the existence of prior art using collet/wedge devices for magnifying a gripping action, there are disadvantages such as the use of a separate tightening collar to be placed around the pole, and operating along a helical screw thread (Partee) and the need in many cases for a part of the anchoring system which remains projecting from the ground even when the pole is not installed.

The inventors were surprised to learn that some expensive, stainless-steel pole assemblies such as flagpoles are sold yet no corresponding system for repeated removal and replacement is offered, apart from sawing off that part of the pole extending from the ground and leaving the remainder embedded in the concrete base.

The problem to be solved could be summarized as being to devise a simple but effective pole-retaining apparatus capable of allowing the pole to be removed and replaced from time to time, and in addition, having minimal impact on an area when the pole is not in place.

A survey of prior art reveals that many sockets to hold poles, such as basketball goal support poles or sign holders, have been described, and many of those include some form of taper lock or collet.

Few if any provide a sound support and/or teach particular insertion or removal tools so that removal is (a) limited to those authorized to do so, and (b) can be carried out reliably and without damage when required. U.S. Pat. No. 5,571,229 to Fitzsimmons et al (dated 1996), (also U.S. Pat. No. 5,752,349) teach an embedded shell, a collet, and use of tapers. In this case, the shell around which the concrete or earth is to be molded is supplied in two halves which are locked together before insertion under the ground surface. The resulting shell plus cap has a rectangular profile in vertical section, except for an inwardly tapered lower end and an inwardly tapered upper opening, comprising a nylon, internally threaded cap that closes down over a series of short tabs, forcing them into the post just below where it emerges from the cap. This is in marked contrast to the single-piece shell with apposed full-length collets and locking means of the present invention, as described below. The post must have a round cross-section. If the post moves upward, perhaps because of vibrations inducted by vigorous play or by wind) after being locked in place, the lower restricted area that makes contact between the post and the shell soon comes out of contact. The only tool used to clamp or release the post is hammer and wedge means to tighten or loosen the nylon cap so that it screws up or down.

Riker (U.S. Pat. No. 7,003,919) teaches a straight-pipe shell to go in the ground, usually into concrete, and a tapered collet surrounding a short portion of the post within the upper end of the shell. Again, there is only a short length of the tapered outer surface of the collet in contact with an adjacent straight cylindrical section, even though the resilience of the preferred plastics will encourage a little deformation.

Sofy (U.S. Pat. No. 5,497,972) teaches a support for a Christmas tree in which a one-piece molded skirt with tapered petals serves as a surround of collets to hold a pole within a base. The skirt co-operates with, when inserted within, a uniformly tapered hole presented to an upper aspect of a base to provide a tapered clamping surround to a cylindrical pole. Screws hold the skirt onto the base and when undone, allow the pole to be removed.

SUMMARY OF THE INVENTION

In a first broad aspect this invention provides anchoring means for fastening an elongate member into a substrate, said elongate member having a foot of substantially constant cross-section, said anchoring means including:

at least one elongate collet having an inward face shaped to fit along and around a section of said foot;

and an elongate housing having an internal cavity shaped and dimensioned to house said at least one collet and said foot in combination;

wherein said at least one collet each has a top end and a bottom end, and an outward face which tapers inwardly from said top towards said bottom in a first portion near said top end and in a second portion near said bottom end, and wherein said internal cavity of the housing tapers inwardly in a corresponding first and second portion;

whereby in use downward pressure on a said collet can create wedging contact between said outward face and said housing near said top end and near said bottom end.

Preferably said outward face of each said collet is untapered between said first tapered portion and said second tapered portion, whereby in use substantially no wedging contact occurs between it and the housing between said first and second tapered portions.

Preferably said at least one collet and said housing are formed from a resilient plastics material.

Preferably the anchoring means includes two said collets forming substantially complementary parts of a sleeve shaped and arranged to surround said foot in use.

Preferably said at least one collet includes an outwardly projecting flange at said top end.

Preferably said housing includes a collar shaped and arranged to house said flange.

Preferably said collect includes a longitudinal slot extending downwardly from said top end;

the anchoring means further including a key shaped and dimensioned to fit into said slot, to engage between said foot and said housing through said collet in use.

Preferably said housing further includes a recess and a metal backing plate arranged to be engaged by said key in use.

Preferably said key comprises a flat blade having an edge arranged to engage with said foot in use, said edge being concave in cross-section so as to provide paired parallel sharp edges.

Preferably said key includes a flange at a top end thereof, substantially corresponding in size and shape with a section of said slotted collet, so as to sit flush with the top end of said collet in use.

Preferably said inward face of each said collet includes a plurality of transverse ribs near said top end and near said bottom end, to engage with said foot in use.

Preferably said housing includes at least one aperture at or near said bottom end, dimensioned and arranged to admit electrical wiring.

Preferably said housing includes at least one frangible membrane, dimensioned and arranged to admit electrical wiring when punctured in use.

Preferably said housing includes at least one longitudinal rib on a wall of said internal cavity, adapted and arranged to key with said at least one collet, to prevent rotational movement of said one or more collets around said housing in use.

Preferably one of said foot and said housing includes a transversely projecting pin, and the other includes a transversely extending aperture therein shaped and arranged to engage on said pin, whereby in use downward pressure on a said collet can press said pin into engagement with said aperture, such that longitudinal movement of said foot relative to said housing is prevented by said pin.

Preferably said housing includes one or more projections on an external surface thereof, to engage with said substrate in use.

Preferably the anchoring means includes a collet-removing tool comprised of a handle, a fulcrum, and a crescent-shaped head extending transversely relative to said handle and offset relative to said fulcrum, whereby the tips of said crescent-shaped head can be engaged under said projecting flange at the top end of a said collet, and used to lift said collet with leverage against said fulcrum applied with said handle in use.

Preferably said tool further includes a bearing block adapted and arranged to fit under said fulcrum.

Preferably said head is pivotally mounted with respect to said handle and said fulcrum.

Preferably the anchoring means includes a cap, dimensioned and adapted to engage into said collar.

Preferably said cap is annular, and is dimensioned and arranged to fit around said elongate member.

In another broad aspect the invention provides a method for fastening an elongate member in a substrate using the anchoring means described above, comprising the steps of:

setting a said housing into a hole in said substrate, using a settable fluid construction material such as concrete;

inserting a foot of said elongate member into the internal cavity of said housing;

inserting at least one said collet alongside said foot into the internal cavity of said housing;

applying downward pressure on said at least one collet to create wedging contact between said collet and said housing near the top end and near the bottom end.

Preferably a said collet includes a longitudinal slot extending downwardly from said top end, and said anchoring means further includes a key shaped and dimensioned to fit into said slot;

further including the step of fitting said key into said longitudinal slot to engage between said foot and said housing through said collet.

Preferably the method further includes the step of applying an annular cover over said housing around said elongate member, and engaging said cover in a collar on said housing.

In a further broad aspect the invention provides a method for removing an elongate member fastened in a substrate using the anchoring means described above, comprising the steps of:

engaging the tips of said crescent-shaped head of the tool under a projecting flange of a collet; applying pressure to said handle of the tool, to lift said collet with leverage against said fulcrum; removing said collet;

and removing said elongate member without damage to the components of the anchoring system.

In a further broad aspect the invention provides apparatus and a method for mounting a post for a fence, wherein the post of the fence has a rectangular cross-section and the collets and housing are shaped accordingly.

DESCRIPTION OF PREFERRED EMBODIMENT

Figure 1:
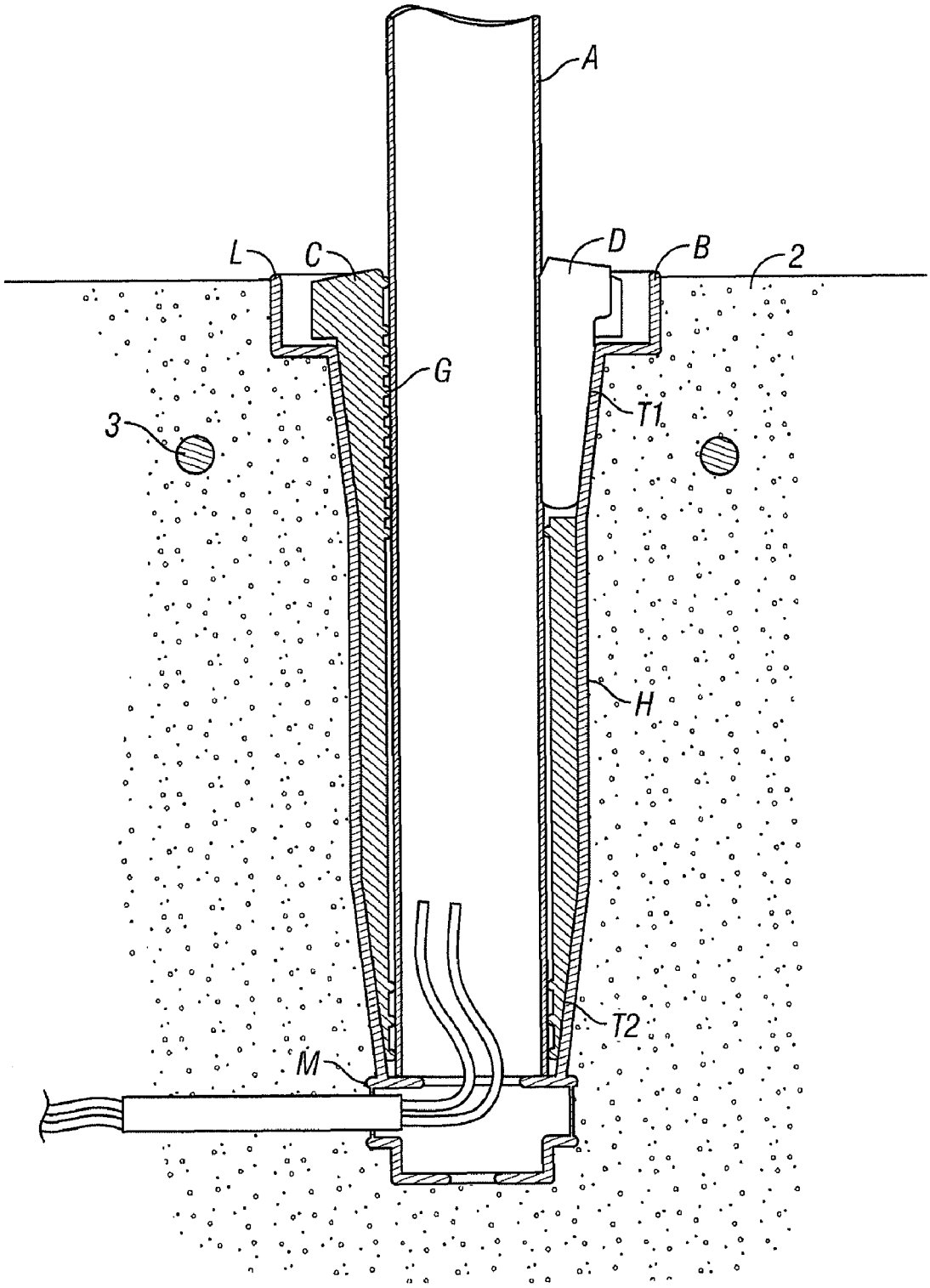
FIG. 1 is a cross-section of a post fixed in the ground according to the invention.

The description of the invention to be provided herein is given purely by way of example and is not to be taken in any way as limiting the scope or extent of the invention.

Throughout this specification, unless the text requires otherwise, the word "comprise" and variations such as "comprising" or "comprises" will be understood to imply the inclusion of a stated integer or step or group of integers or steps but not the exclusion of any other integer or step or group of integers or steps.

The orientation terms top or bottom or other references to a vertical or horizontal orientation are used for clarity of explanation, but it will be appreciated that the invented apparatus may be oriented in any direction and in such a case these terms must be translated accordingly.

In summary this specification describes a quick release locking system for ground fixtures particularly a post A having a constant cross-section, and provides a ground-embedded housing B, a pair of free-standing locking members (collets or wedges) C, and a key D. Tools for inserting, locking and later removing the locking member are described. In use, the post A is placed loosely in the internal cavity of the embedded housing B then one locking member C is driven down on each side of the post. It may be that only one locking member C is hammered into place.

The preferred locking members (called collets or wedges) C are shaped (preferably by injection molding or equivalent procedure) to fit closely against the post cross-section on an inward face, and to fit closely inside the housing on an outward face, and are preferably made of a plastics material in order to provide a little resilience that increases contact area; and to provide resistance against corrosion.

Example 1

This invention relates to a system for reversibly anchoring a post (or pole, pipe, shaft, beam, mast, etc) in a substrate (2) such as the ground or a wall. The illustrations and the key to the part identification includes many details. In principle the invention employs two main components—the housing, permanently buried at a designated spot, and one, two, or more wedges of a type known as collets because they are shaped to wrap around a shaft together with anti-rotation means, locking means, and removal means.

Post A: may be a hollow conduit or pipe carrying fluids or protecting conductors such as copper wiring or fiber optic materials. Preferably the post A is made of a slightly deformable material—as per FIG. 1, where the key D that has been hammered into place has deformed the post A at a point of contact. This assists in preventing movement of the post and helps to retain the key. Deformable materials include most metals and some plastics but care must be taken that a selected plastic does not crack and fail on account of the deforming pressure. Note that the post itself is not part of the anchoring invention, although the invention is unlikely to be assembled properly without including a post within.

Housing B: This is a shell (hatched thick line B in the elevation section of FIG. 1) that is preferably made of a strong and durable, non-corrodible material; in metal but also preferably made in plastics. The housing B will usually be embedded in concrete for use, so that an almost incompressible surrounding is provided around the exterior of the housing when in use. Steel reinforcing rings (3) may be embedded in the concrete to provide tensile strength. Fins or other protrusions may be used on the exterior surface of the housing in order to improve attachment and to prevent undesired rotation of the housing, such as caused by a wind blowing on an unsymmetrical sign. The inside of the housing is provided with tapered portions T1 and T2 corresponding closely with those on the outside of the collets C described below, and hence should be reasonably precisely shaped. If made in cast metal, the tapered area could usefully be finished with a cutting or grinding operation. One advantage of a taper is that there is some useful tolerance as to width. The inside surface of the housing may be provided with two or more vertical ribs Y, which act to guide and hold the collets C against rotation within the housing. At the top end of the housing, an outwardly projecting collar L is provided. The inside surface of the collar L is preferably provided with horizontal ribs Z, which in use maintain a gap between the housing and the heads of the collets C, into which a removal tool can be introduced as described below. At the foot or bottom end of the housing, a preferably knockout type of wiring aperture M may be provided, by which pipes or wiring can be introduced into the base of the housing below the collet C. The dimensions of the housing are typically 30 cm deep by 12-15 cm in diameter, depending on application. The interior of the housing may also include key guides (see later).

Figure 3A:
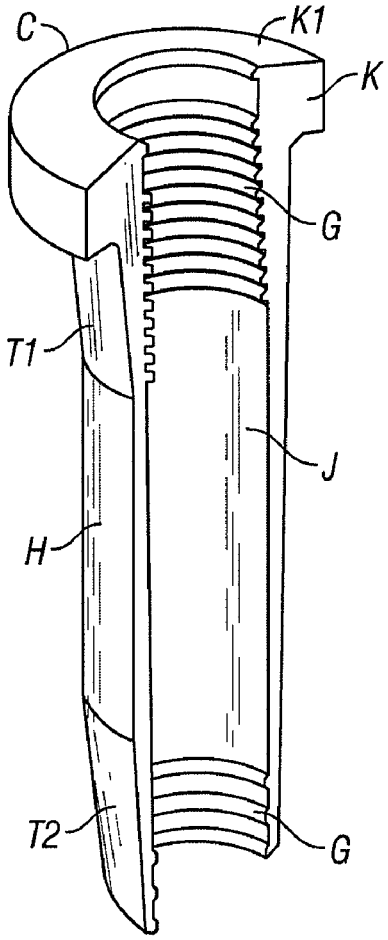
FIG. 3 (as FIGS. 3*a* to 3*d*) shows collets and a key in perspective view.
Figure 13A:
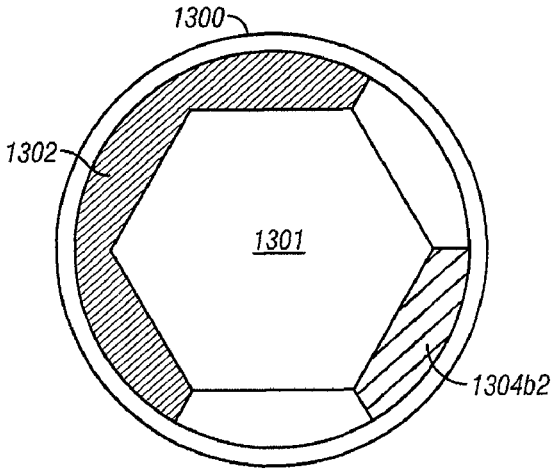
FIG. 13 (as FIGS. 13*a* to 13*f*) shows in cross sections how the invention can cater for variations on a round post in a round hole, such as hexagonal posts.

Collet C: is a shaped wedge not unlike collets used in engineering to hold tools with a locking process effected by forcing the tapered collet into a tapered hole. The basic collet comprises perhaps a third or a half-circle around the post A, as seen in plan view, shaped so that the inward surface J generally conforms to the exterior of the post A, preferably with horizontal ribs G at upper and lower parts of the inward surface J, to resiliently deform against and/or press into the post A to grip it securely at an upper and a lower part of the collet. The outward surface H conforms to inner wall of the housing B, with attention given to the angles of the upper and lower tapered areas T1 and T2. Specific collets may be provided for different sizes and shapes of post and for a lesser variety of housings. A square peg can be fitted into a round hole with this system using appropriately shaped collets, as shown in FIGS. 3*d* and 13*d*. The head K of a collet C comprises an outwardly projecting flange, shaped and dimensioned to fit within the collar L of the housing B. The upper surface K1 of the head K is preferably slightly sloped downward towards the outer edge, and provides a surface which can be hammered to drive the collet C into place in use.

The apposable tapered zones (T1 and T2) on the housing B and the collet C serve to wedge the pole and the collet into place when downward pressure is applied to the collet. Use of an upper and a lower taper both having a significant tapered area tends to make a more stable mount since the item held cannot rock to and fro against any high point or obstruction in the mid-height part of the anchor. Of course the inter-taper length has to be well controlled so that both tapers co-operate to hold the pole in place. With a continuous taper a similar pressure would be applied right through the supported area, making the locking system of the invention susceptible to vibration and flexing by rocking about the middle.

Suitable materials for collets include metal which may be cast or milled, but more preferably are a tough plastics material, including for example polypropylene and high-density polyethylene, which may be made by injection molding. The slight flexibility of this material provides an advantage in combination with the use of two tapered zones as described above. When removing the collet, the top tapered zone T1 can be pulled free with leverage applied to the top of the collet, while the other zone T2 remains wedged. The intermediate area is stretched out. The pulling force then transfers to the second zone T2, to release it also. If the collet were formed from an inflexible material, or if the taper extended continuously along the entire length of the collet, a much greater pulling force would be required to free the whole wedged section of the collet at once.

Each plastic material has its own shrinkage characteristics. Preferably collets are made in a single molding operation but the known effects of plastics-dependent shrinkage such that which occurs after release from the die may necessitate subsequent finishing operations—although the cost of those is mitigated by the use of cheaper plastics. Cutting, grinding with NC machines and brief searing contact with very hot shapes are possible techniques for post-finishing. Preferably all parts of the finished item are made at the same thickness, to help in the cooling characteristics, as is known in the relevant arts.

Figure 3B:
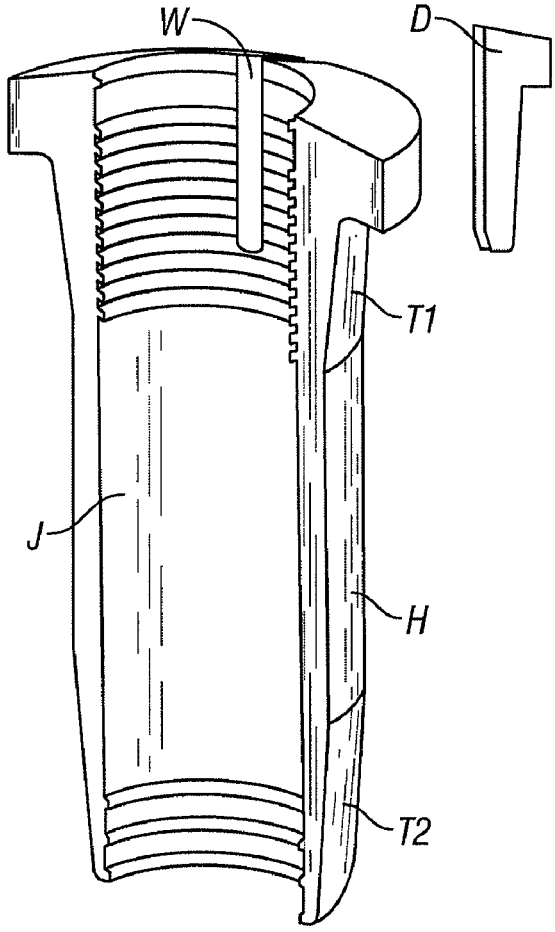
Figure 3C:
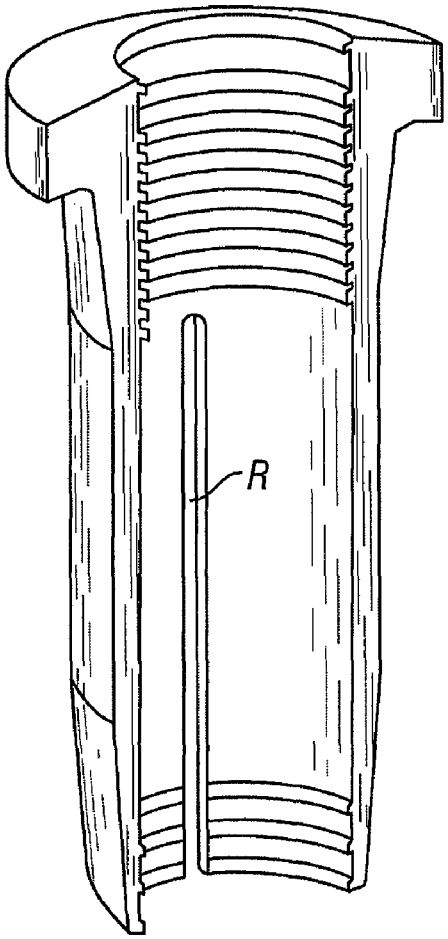
Figure 3D:
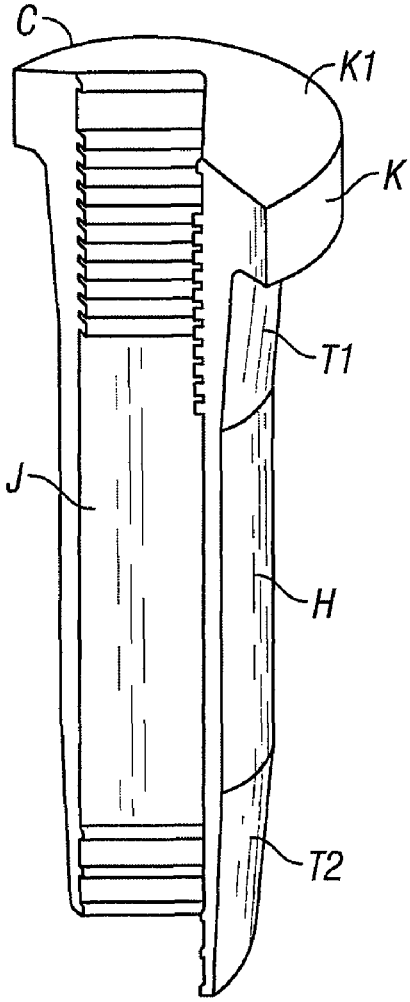

The collet C may be modified to accommodate locking devices, as described below, with slots W or R as shown in FIGS. 3*b* and 3*c*.

Key D: As shown particularly in FIG. 4, the key D has a head D1 (adapted to allow the key to be hammered into place and then levered out of place after use), and a blade D2 (adapted to bear tightly against the post A in order to retain it), which tapers towards the lower end so that the key is also wedge-shaped. It may be made of mild steel, perhaps stamped out or otherwise cut. The key is wedged between the post A and the housing B, passing down a groove W cut in a collet as seen in FIG. 3*a*. The key should have a concave v-cut inner edge N for pressing against the post, so that it has two parallel sharp edges which can cut into and deform the pipe and provide a more secure holding action on the curve of a round post, as is shown particularly in FIG. 4.

Figure 4A:
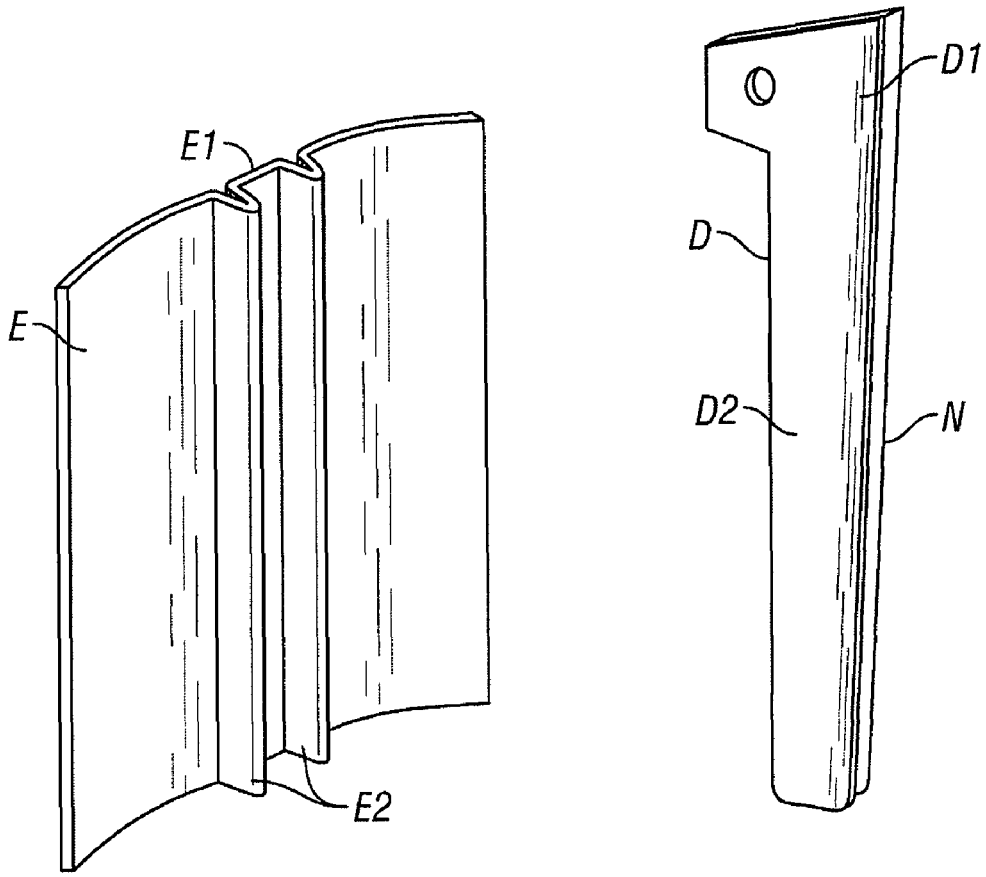
FIG. 4 (as FIGS. 4*a* to 4*e*) shows a key and a backing plate, according to the invention, in perspective view and plan view.
Figure 4B:
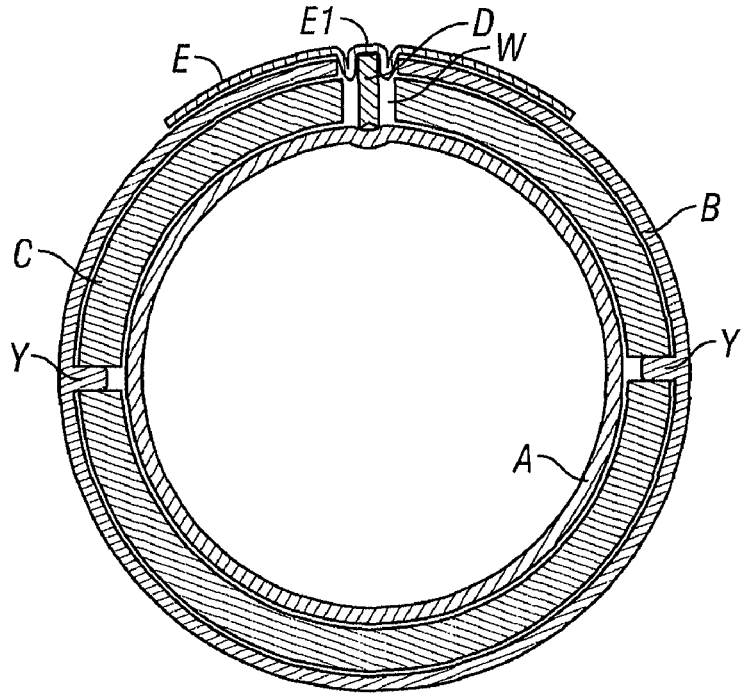

The post should be prevented from rotating or from being rocked from side to side and then working its way out of the mount. FIG. 4*b* shows placement of the key D in a slot W in a collet C, to engage with both the post A inside and the housing B outside. A metal plate E is preferably provided in the housing B, against which the key D can bear. This may comprise a flat plate or may comprise a formed metal plate as shown in FIG. 4, which is typically 50×75 mm and made of 1.2 mm thick galvanized steel, and has been folded so that it is curved and includes two ridges E2 that define the sides of a key-compatible slot E1 that the key D may slide down. The plate E is preferably mounted on the outer surface of the housing B, behind a slot cut through the housing B down which the key D is hammered, so that the plate E bears against the concrete (2) surrounding the housing. The concrete may preferably be reinforced (such as by steel ring 3 in FIG. 1) because this type of usage will impose tensile forces. By this means a firm bearing surface is provided outside the key D as it is hammered down into the slot W, such that the inner edge N is pressed into and deforms or cuts into the material of the post A, to lock it against rotational movement relative to the collet C or housing B.

Figure 4C:
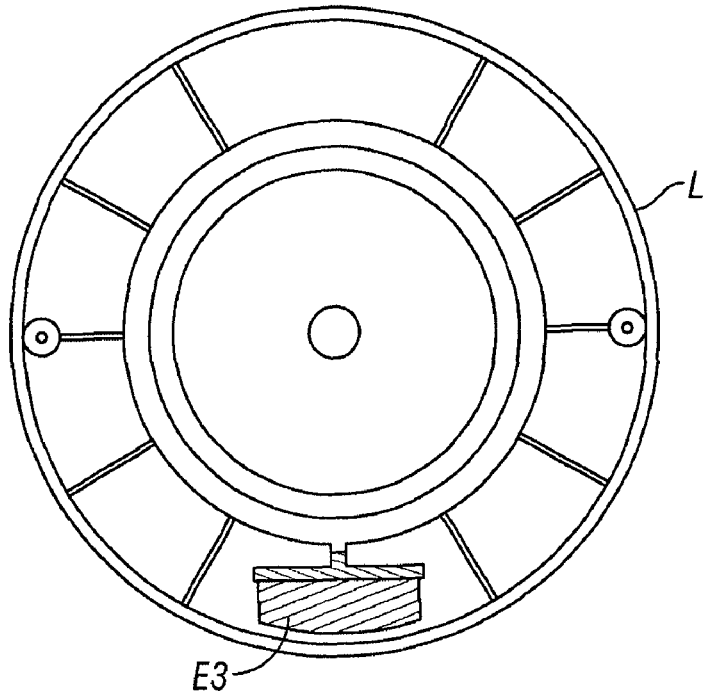
Figure 4D:
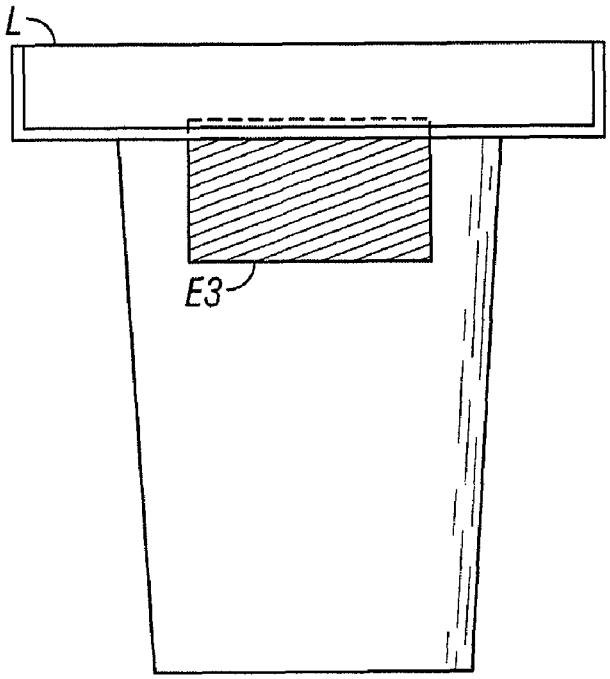
Figure 4E:
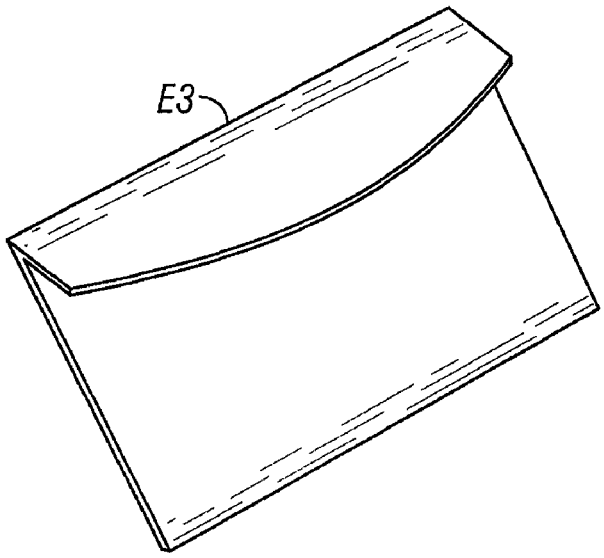

A further type of key is designed to prevent the housing from spinning around inside the ground material, typically cast concrete. FIG. 4*c* shows a view of a housing from above, with L indicating the expanded uppermost portion (seen also in elevation view in FIG. 4*d*). FIG. 4*e* is a perspective view of a bent metal key which for example is about 50 mm wide and 50 mm deep, with a bent-over lip at one end that lies inside the border of L as shown in FIG. 4*c*. Housings are provided with a thin slot that retains a membrane of plastic unless an installer has burst the membrane by the act of inserting key E3, which is done before the concrete is poured around the housing so that the key E3 is surrounded on both sides by concrete. This anti-rotation key works by pressing firmly, along its centre axis, against the outside of the vertical part of the housing (at T1, with reference to FIG. 1). The vertical edges of key E3 tend to cut into the concrete if a turning action is forced onto the housing L and so on to the key E3.

Figure 6A:
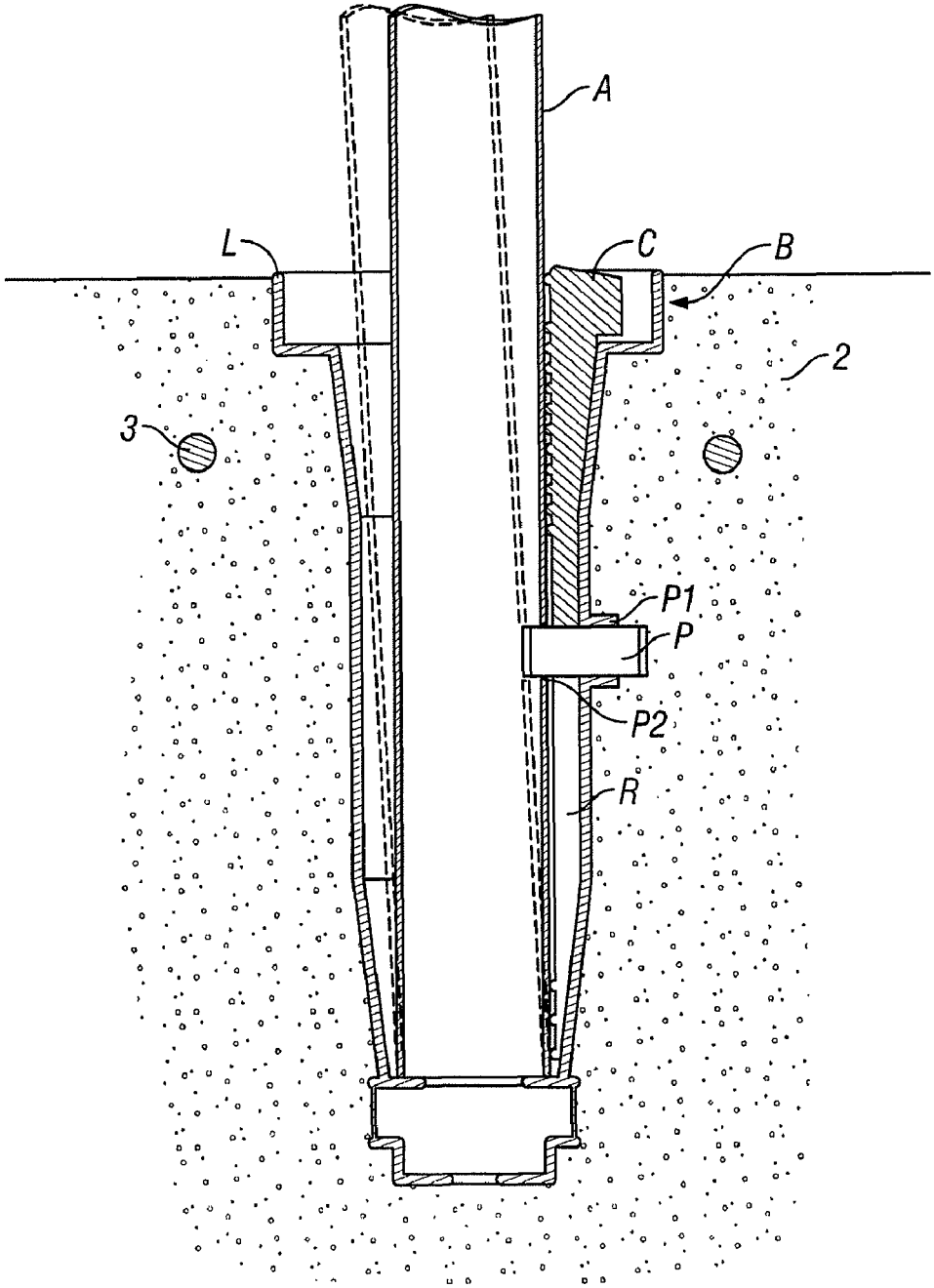
FIG. 6 (as FIGS. 6*a* to 6*b*) shows details of a locking pin in relation to the foot of a post.
Figure 6B:
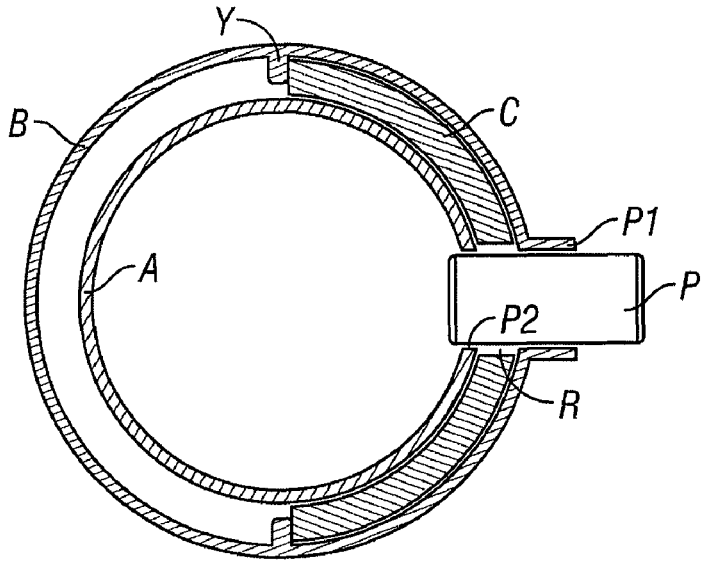
Figure 7:
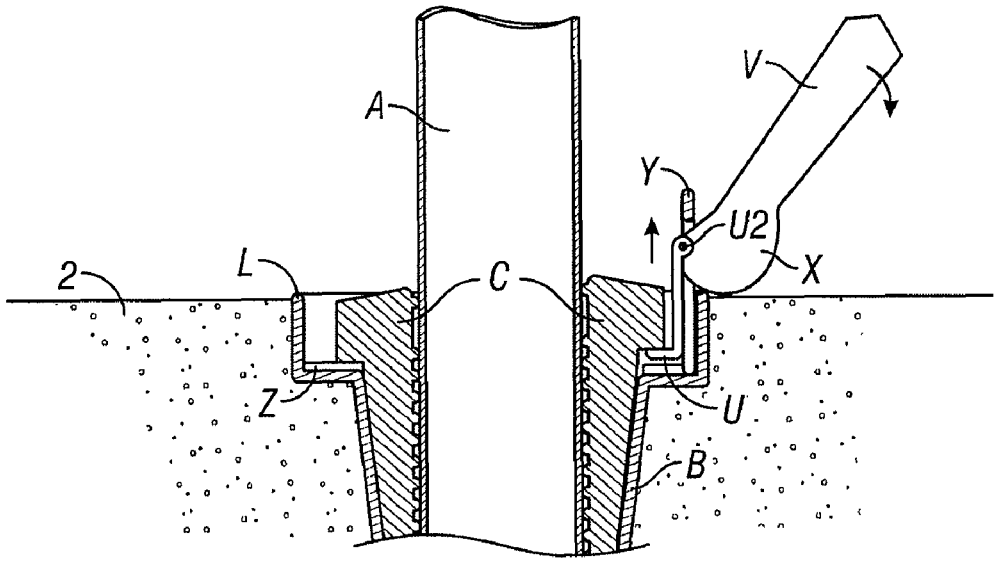
FIG. 7 shows a collet removing tool in use.

Lock Pin P: A further means may be provided for preventing rotation and/or withdrawal of the post A from the anchoring means, as shown in FIGS. 6 and 7. A lock pin P is provided, extending transversely from or through a mounting P1 in the housing B into the internal cavity. As shown in FIG. 6 and FIG. 3*c*, the collet C is modified to provide a longitudinal slot R extending upwardly from the bottom, which can fit over the lock pin P, so that it passes through the collet C into contact with the post A. The post A is preferably also modified with an aperture P2 at the appropriate height for the pin P to pass into. With the second collet C not yet in place, the post A can be tilted to allow it to slide past the lock pin P. Then when the pin P is located next to the aperture P2 the post A can be tipped upright to engage the pin in the aperture, and then the second collet (not shown) pressed in on the other side to hold the whole assembly in place. By this means the post A is prevented from rotating or sliding longitudinally relative to the housing B.

Figure 8:
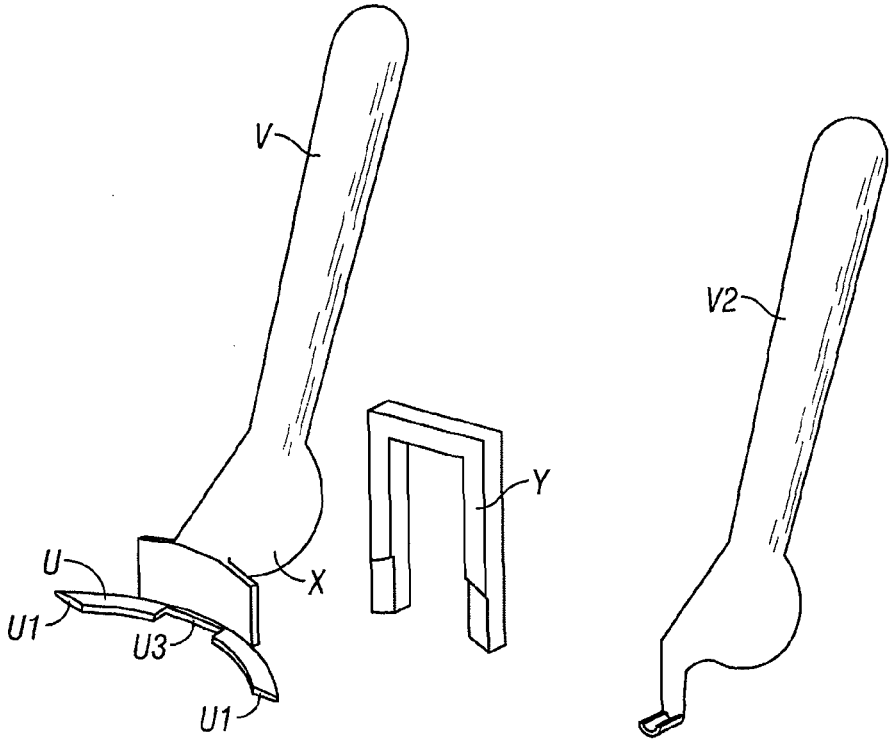
FIG. 8 shows collet and key removing tools in perspective view.

Collet removal: Two configurations of lever for use in collet removal are shown in FIG. 7 and FIG. 8. It will be appreciated that this configuration is uncommon in ordinary tools. For example a screwdriver would have no useful purchase under the head of the collet. The lever is a form of security in that persons without one would find it very difficult to remove a post. This lever has a shaft of convenient length (30-50 cm) so that a user has a suitable amount of leverage, and a shaped head extended sideways from one end. As shown in FIG. 8, the head of the tool comprises a generally crescent-shaped head U and a fulcrum X. In use the tips U1 of the head U are inserted under the head K of the collet, and levered with the fulcrum X bearing against the collar L of the housing B and/or on the surrounding concrete substrate 2. Ridges Z on the inner surface of the collar L ensure that a gap remains under the flange K for the purpose of inserting the head of the tool. The head U may incorporate a recess U3 to fit around the key D, so that the collet C can be removed independently from the key D.

Preferably, the tool V is formed and arranged so that the fulcrum X will bear against the substrate 2 in which the housing B is mounted, rather than the housing B itself. Often an air gap may be caught above the poured concrete and under the collar L of the housing B, and without the support of the substrate material the collar L may be too weak to bear the pressure of the fulcrum X. Accordingly a separate bearing plate Y may be provided, to lie between the fulcrum X and the collar L, and/or the head U may be pivotally mounted (U2 in FIG. 7) relative to the fulcrum X, and arranged to fit under the flange K in the collar L while the fulcrum rests on the upper surface of the substrate (2) outside the housing B.

It will be appreciated that the shape of the tool will be modified to suit the dimensions and shape of the collets C used in a particular application N for example, if the system is applied in a square form for mounting square-section posts (as described below) then the collet removing tool V will have a straight or V-shaped head U, rather than the crescent-shaped head U described above.

Figure 12A:
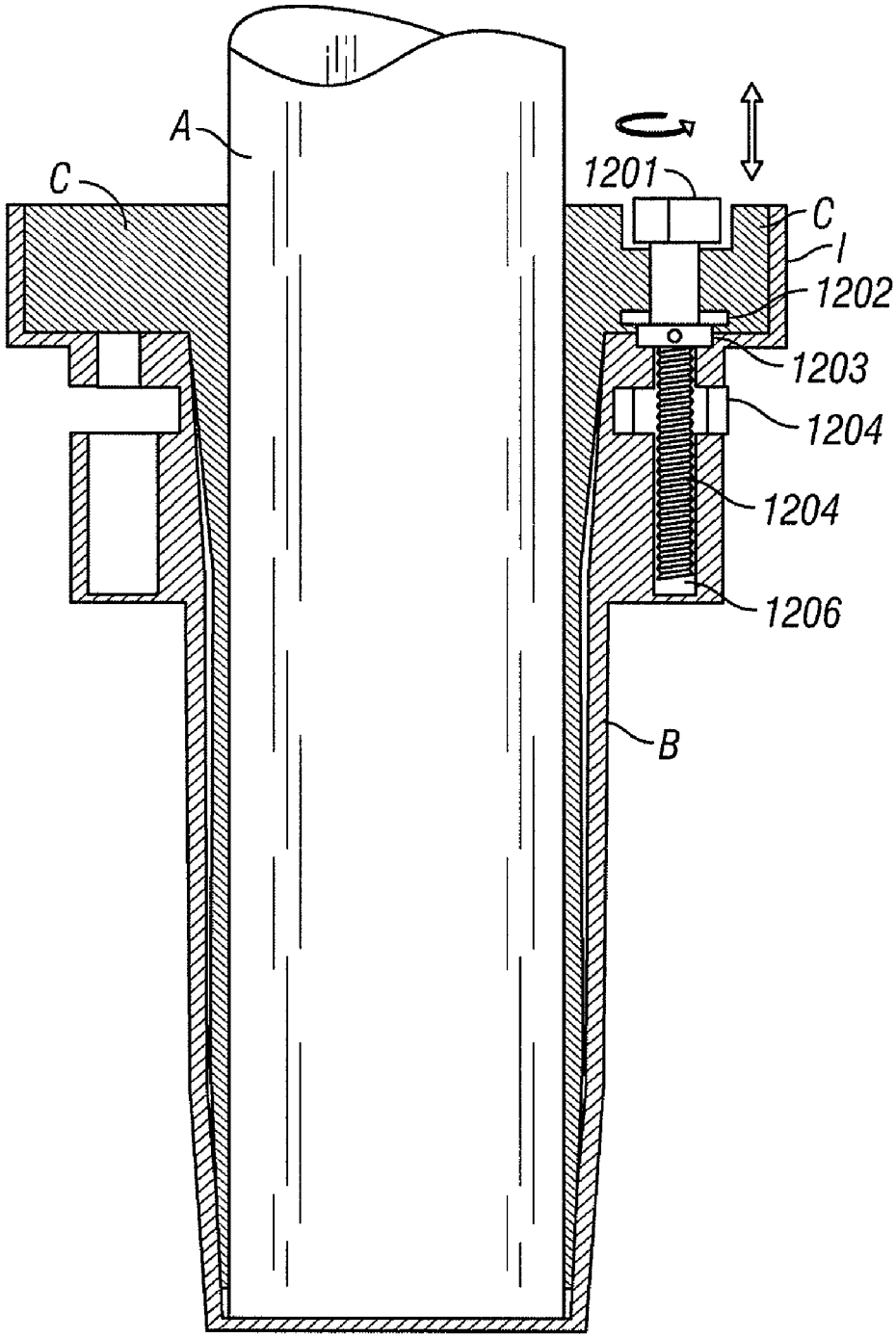
(in FIG. 12*a*) illustrates use of a bolt to apply removal forces to a collet (in FIG. 12*b*).
Figure 12B:
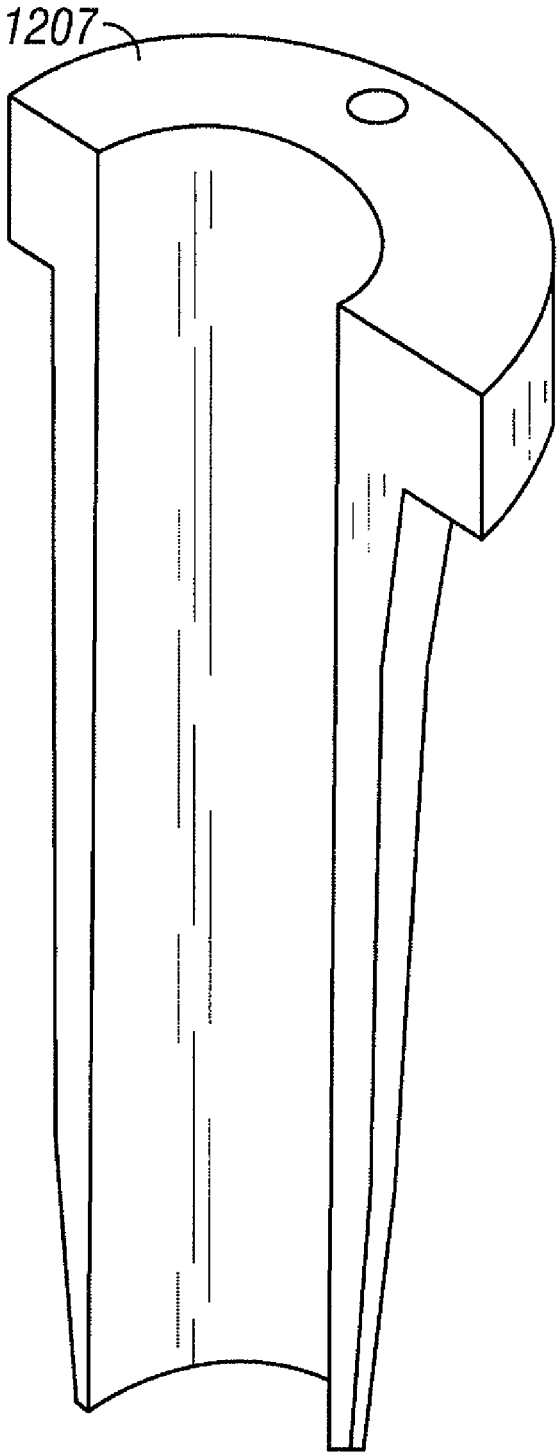
FIG. 12.

Other removal procedures: It will be appreciated that the same or a similar tool V2 may be used to extract the key D. It will also be appreciated that other means may be used to extract the collets from the housing, such as for example a screw passing vertically down through a threaded aperture in the head K of the collet, and bearing against a plate on the collar L, which can raise the collet when turned, as shown in FIG. 12. FIG. 12 shows use of machine screws as hold-downs and as removing devices for a collet-based post anchor. This is an alternative way of providing for insertion or removal including a mechanical advantage. The post is A; the collet housing is B, and two collets are shown as C on each side of the post. L indicates the outer edge of the surface expansion of the housing. Bolt 1201 has a drivable head which may be engaged with a socket spanner, or some "security head" may be used to prevent unauthorized removal. The bolt shaft includes a subsequently attached fixed washer 1203 that can turn against washer 1202 that forms part of the collet. The shaft of the bolt includes a conventional thread 1205, which passes through captive nut 1204. The thread is otherwise free to turn in space 1206. When the bolt head is turned, the bolt is either pulled down into the housing by engagement with the captive nut, or if rotated in the opposite direction, turns against the collet washer 1202 and causes the bolt to rise out of the housing, so that the collet is forcibly withdrawn from the housing and the post is thereby freed from the anchor B. 1207 is a perspective view of a collet of this type, including a bolt 1201. The stretching effect previously described is still applicable.

Figure 2:
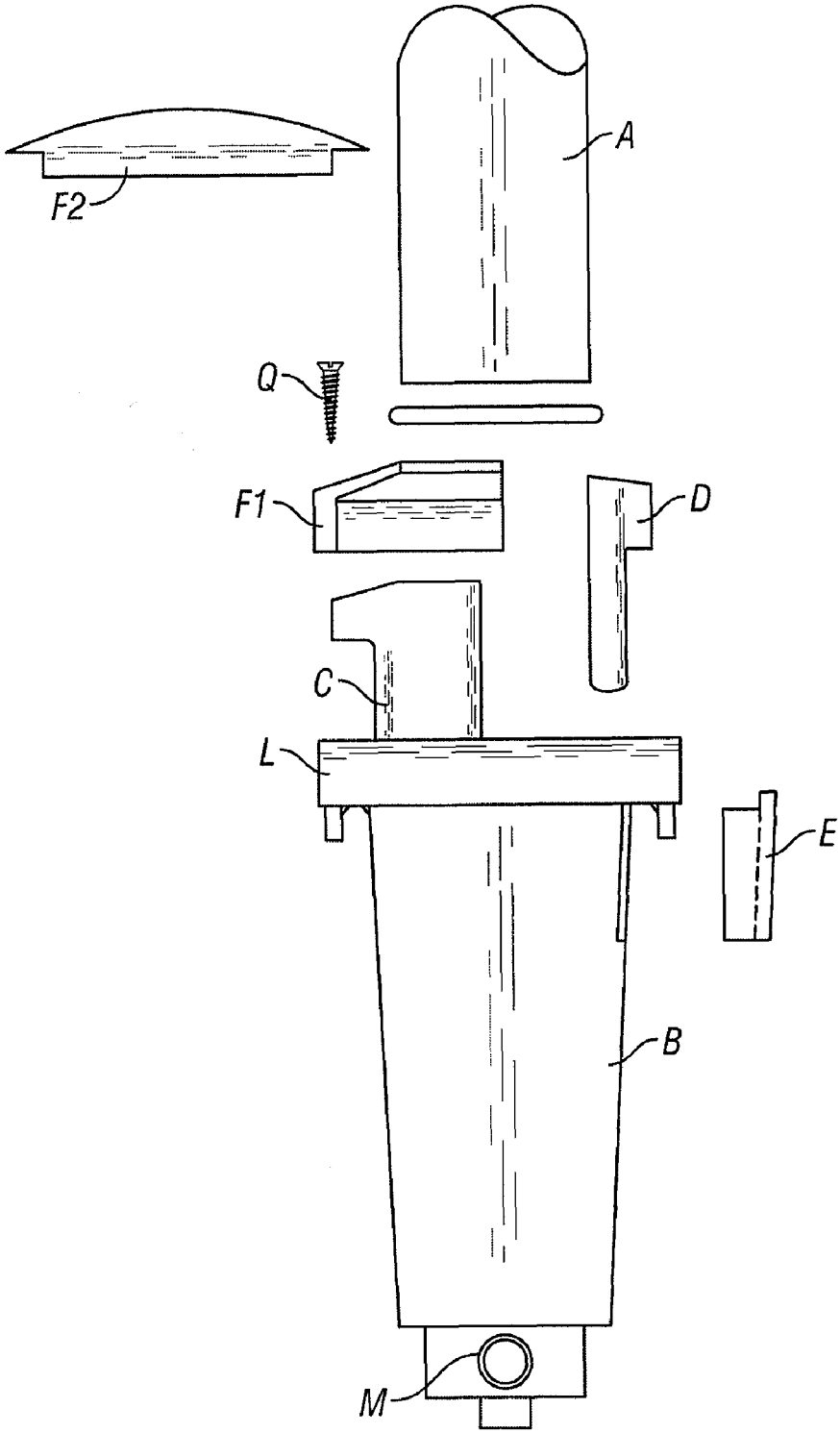
FIG. 2 is an exploded side view of components of the invention.
Figure 5A:
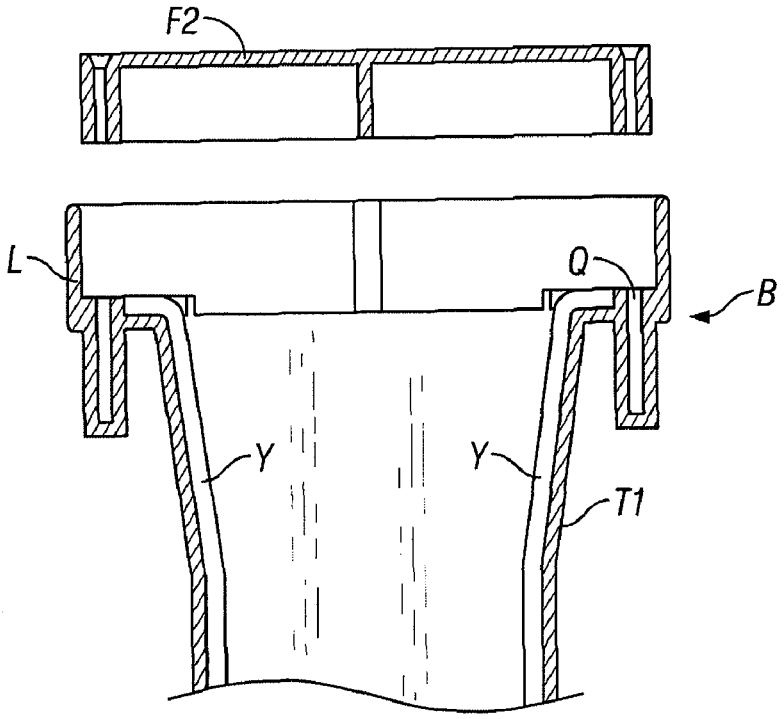
FIG. 5 (as FIGS. 5*a* to 5*b*) shows details of a housing and cap of the invention, in cross-section and in plan view.
Figure 5B:
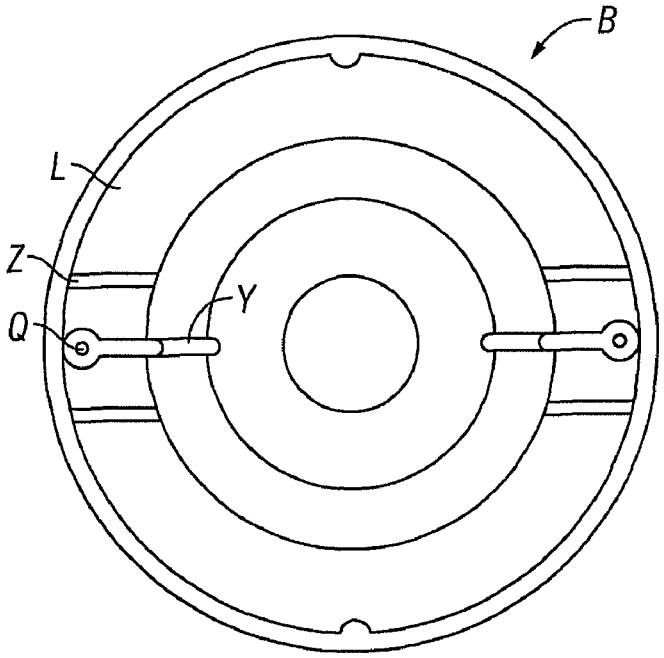

Caps and covers: An injection molded cap (172 in FIG. 2) is available as an optional accessory for use when the post is not in place. The surface may be flat rather than semicircular, as shown in FIG. 5*a*. The closely fitting cap may be placed over the hole to keep rubbish out and to avoid injury to people or animals. Resilient parts or a form of engageable catch (screw or bayonet fitting—not shown), or even a temporary glue (such as "hot glue" resin) may be used to retain the cap. We prefer to screw the cap in place using screw-type fasteners into holes in the housing. For removal of the closely fitting cap we advise (a) removing the fixing screws then (b) screwing larger screws into the corresponding holes in the cap, then (c) using those screws as purchase to pull on the cap with pliers or the like. The cap is also useful to prevent accidental damage to the empty sleeve.

Differing sectional profiles: FIG. 13 shows how this invention exploits a useful result of the use of collets, namely that they can be shaped so as to pack a space and serve as an adapter between usually a cylindrical cavity (in cross-section, though with more than one taper), and a pole having a non-circular cross-section. In all cases the outer profile of the collets is as previously described and illustrated in for example FIG. 3*a*, 3*d* as tapers T1 (an upper taper of about 2.5 degrees slope) and T2; a lower taper of the same slope, separated by a parallel-wall section marked "H". FIG. 13*a* shows how a hexagonal section pole can be accommodated. 1300 is the wall of the shell to be placed against soil or concrete or the like, when in use. 1301 is the outline of a hexagonal pole; commonly supplied made of rolled sheet metal with an overall taper for street lighting applications, for example. The hatched outline 1302 is an example of one half-circle collet and the hatched outline 1303 is an example of a different collet outline. These two types could be used at the same time, or used only as one (either) type at a time.

Figure 13B:
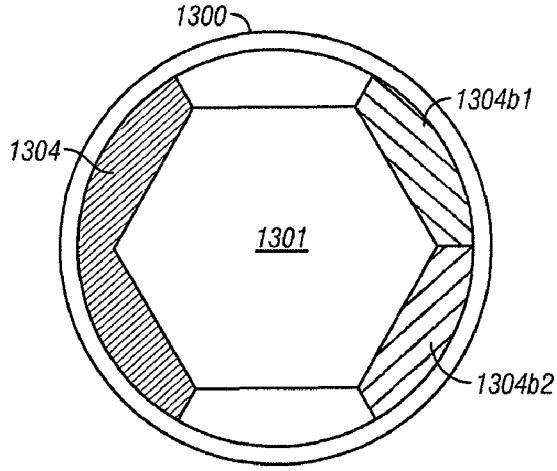
Figure 13C:
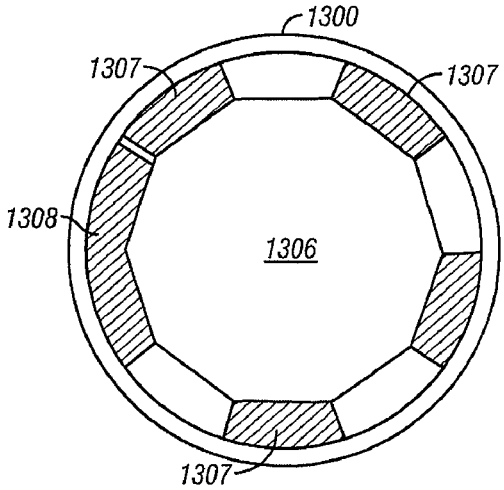
Figure 13D:
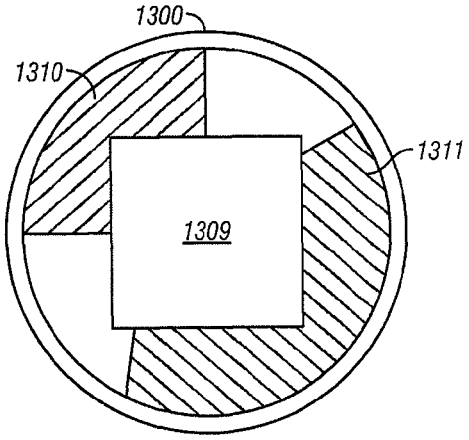
Figure 13E:
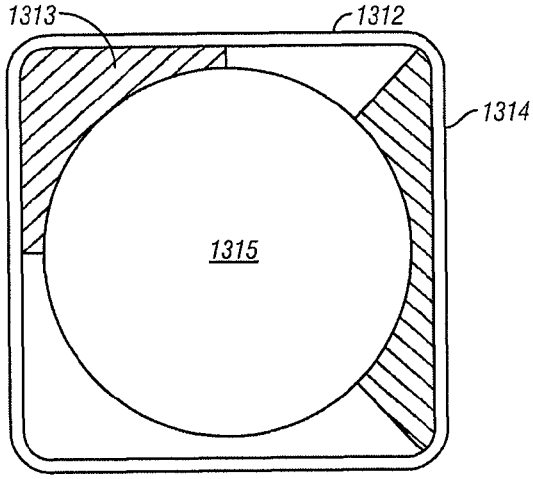
Figure 13F:
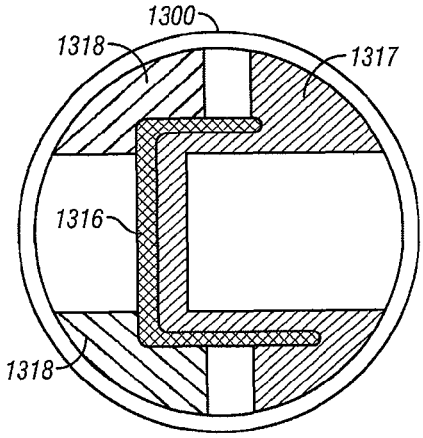

FIG. 13*b* also shows how a hexagonal section pole can be accommodated. 1300 is the wall of the shell placed against soil or concrete or the like. 1301 is the outline of a hexagonal pole; commonly supplied in rolled sheet metal or the like with an overall taper for street lighting applications, for example. The hatched outline 1304 is an example of one 120 degree collet and the hatched outlines 1304*b*1 and 1304*b*2 are examples of yet another, 60 degree collet outline. These two types could be used at the same time, or used only as one (either) type at a time. FIG. 13*c* shows a ten-sided pole outline as 1306. 1307 is one of four 36-degree collets shown in outline, and 1308 is an alternative; a 72-degree collet extending around two facets on the outside of the pole. FIG. 13*d* shows how a square pole may be fitted tightly into a round aperture 1300 by means of at least two varieties of collet section, 1310 and 1311. A converse arrangement is shown in FIG. 13*e*, where a square-section outer pipe 1312 is provided with collets 1313 or 1314 (two styles are shown) that clamp around a circular-section pole 1315. Finally, FIG. 13*e* shows that collets are quite adaptable. A nonsymmetrical "U"-shaped post is held in place with one irregular collet (1317) and two of outline 1318 (not unlike 1310 or 1311). All these illustrative cross-sections are representative and are in no way limiting of the possible variations that may be used.

Variations

Square Fence Posts

Figure 9A:
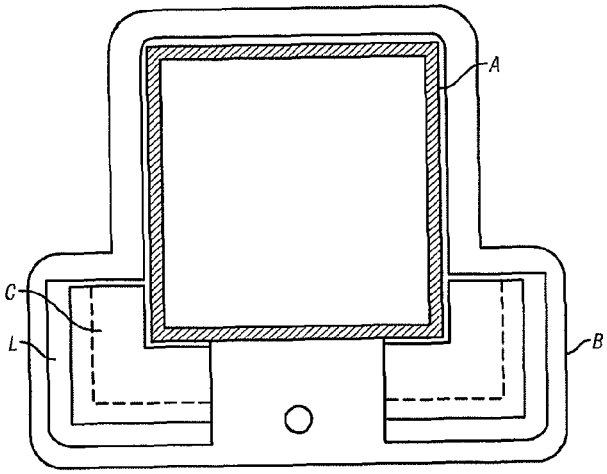
FIG. 9 (as FIGS. 9*a* to 9*c*) illustrates variations related to locking a square pole in place.
Figure 9B:
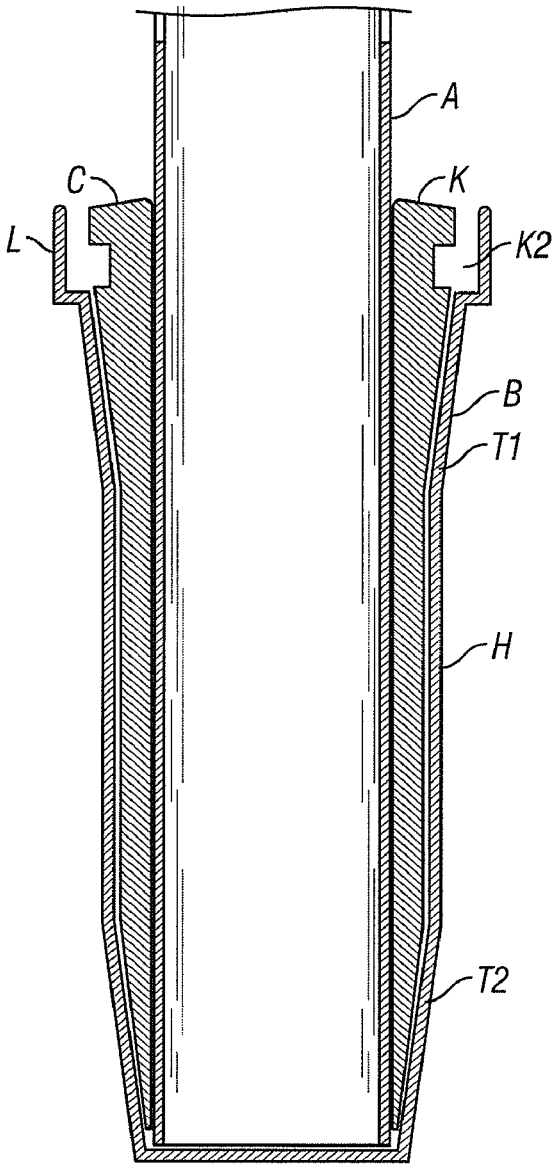
Figure 9C:
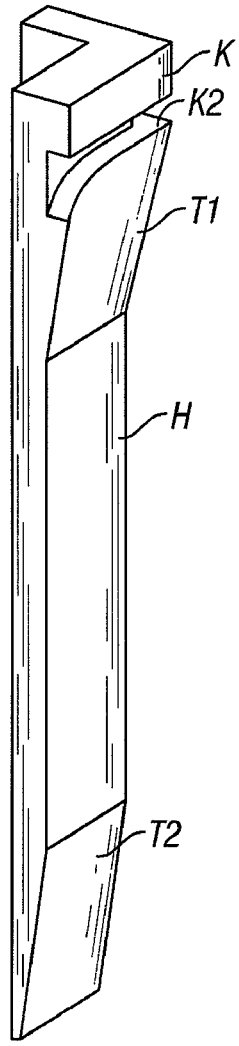

FIG. 9 illustrates how the parts of the invention may be adapted for square-shaped posts that are commonly favored for use in fences where style is important. FIG. 9*a* is a plan view and FIG. 9*b* is a sectioned front view, showing a squared housing B around a square post A. Two square collets C (see 9*c* for a perspective view) hold the post in place. Two collets are used on the same side of the post so that they are accessible from one side of the fence, whereas other positions would lie behind the fence material and may be difficult to access. Q is a screw hole used to secure a cover. Note that this system ensures that the post walls are orientated in line with the length of the fence. In the collet shown here, a lever slot K2 is provided in the head K of the collet, which can be accessed with an appropriately shaped tool in the collar L of the housing B.

Frangible Posts

There are some applications such as crowd control, where posts may be erected but if pressure becomes too great (such as during emergency emptying of a stadium) it is desirable that the posts give way in a safe manner. Posts can be provided for use with the above anchoring system that snap cleanly at ground level when over-stressed so that (for example) if a crowd in panic has trampled down the posts, individuals are not injured on protruding stumps thereafter. Later, the broken-off base can be extracted and the entire post can be replaced cheaply without having to pour new concrete, for example. Roadside signs should also break into a safe configuration if hit by a vehicle.

Electrical Routing

FIG. 1 illustrates how the parts of the invention may be adapted in order to carry electrical wiring into the interior of a hollow post for lighting, telephones, traffic lights, loudspeakers and the like. A cable (see also FIG. 2) has been buried in the ground and feeds its wires through an aperture M at the base of the post. The aperture M may be pre-formed in the housing B, or alternatively may be provided as a frangible membrane with a guide rim, which can be easily perforated for the insertion of wires or connection of pipes, but which serves as a waterproof seal if not perforated.

Support of Pines Carrying Water etc

It will be appreciated that this invention provides apparatus and a method for removably fixing in place a pipe or other elongate member passing through or into a wall using anchoring means as described above, applied horizontally instead of vertically.

Figure 10:
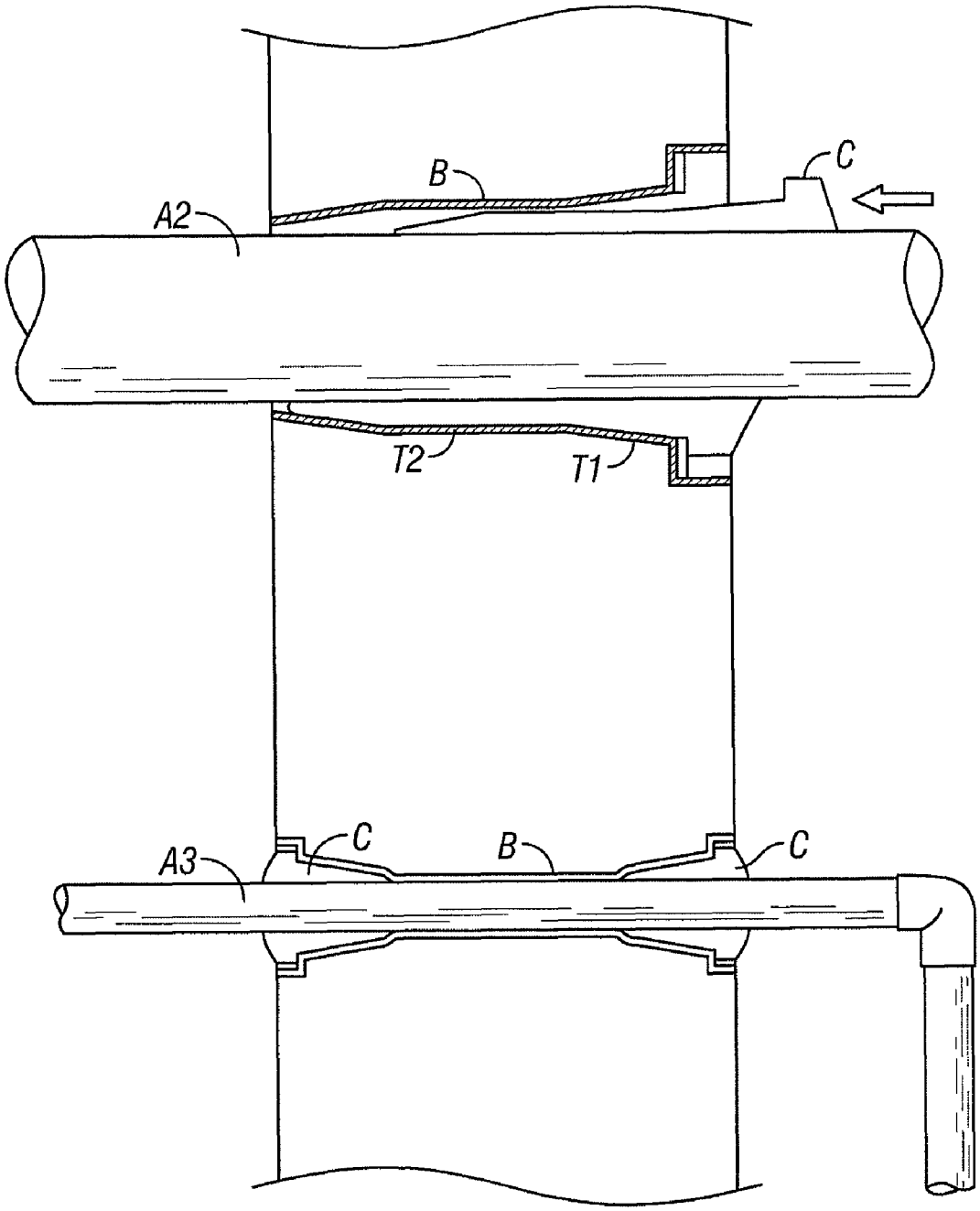
FIG. 10 shows the variations related to holding pipes that pass through a wall (or the like).

FIG. 10 illustrates how the parts of the invention may be adapted for carrying a fluid such as a water pipe through a wall. A large pipe is shown as A2. As it passes through a hole in the wall the pipe is surrounded by a housing B (either slipped over the pipe from a free end or provided as a pair of shells) and the pipe is clamped in place by means of collets C. The upper part of FIG. 10 shows a single-ended collet assembly and the lower part shows a double assembly around a smaller pipe such as a gas pipe or water pipe A3. We have found that this version offers, among other advantages, the benefit that sound travelling along the pipe is deadened at the collets, at least partly owing to a property (also well-known in lead) of hysteresis and mass, hence absorption of sound. It may be set up with a level of tightness which can allow the pipe to slide within the collet should there be earth movement or an earthquake.

Anchors for Hand Rails into Walls

A process as above can be used to anchor an end of a hand rail into a wall made of such as brick or concrete.

Watertight End-to-End Joints Between Pipes.

Figure 11:
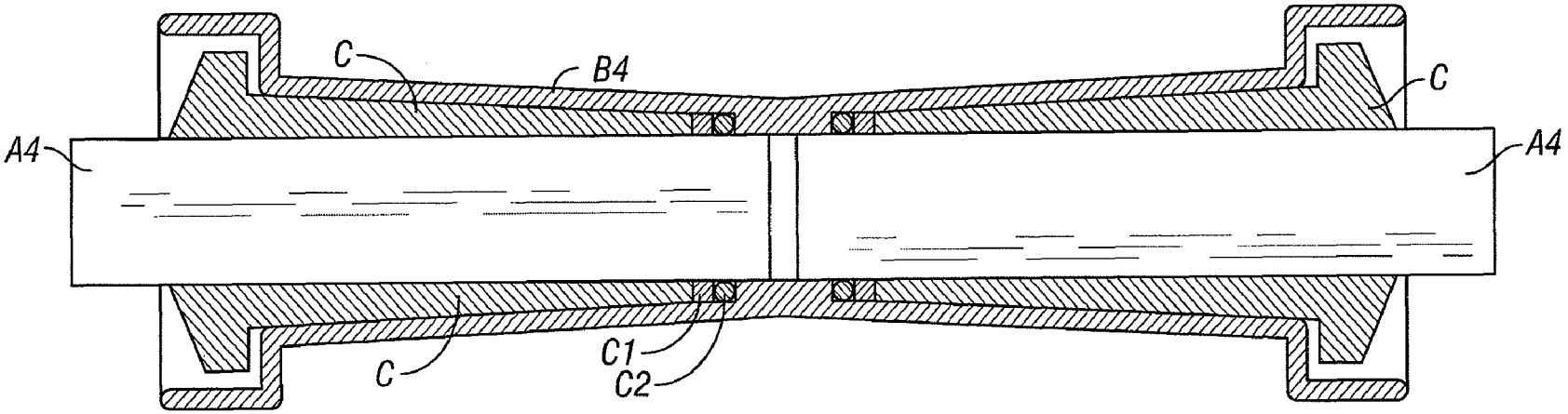
FIG. 11 illustrates a way to seal a junction between two pipes at a position where collets are placed.

FIG. 11 shows how the collet/housing assembly may be used in an only slightly modified form as a junction between pipes. There is no requirement that the assembly be mounted in the ground or in a wall, for example; it may be free-standing. The lumen of the pipes is shown at A4. A modified housing B4 forms a complete ring around the approximately flush ends of the pipes. The housing includes an interior flange that makes an approximate contact with the pipe exteriors. Sealing is provided by means of the pressure applied by the collet C bases applied against a pressure-equalizing ring C1 that in turn presses against an 0-ring C2 that is forced into a sealing contact. One such O-ring is used on each side. When this collet assembly is put together and held in place by keys a tight seal is provided at the ends of the pipes without using welding or the like. The idea may be used to match pipes having different diameters, and may be used in re-erectable, temporary plumbing such as in military camps and fairgrounds (for example).

Farm Fencing and Yards.

Concrete floors and galvanized iron pipework serving as fencing, bails, and races is widely used in New Zealand at least for the construction of animal yards, cowsheds, and in other countries for barns to house animals. When the pipes are directly set into the concrete, corrosion in electrolytic cells may be set up for wet concrete is a reasonably good conductor, and the pipes cannot be moved around. One application of the present invention is to provide non-conducting sockets for pipes which minimize corrosion, even if some pipes are of stainless steel and others are of galvanized iron,

INDUSTRIAL APPLICABILITY AND ADVANTAGES

Considering the invention as means to provide reversible, secure anchoring of a post in the ground, applications include:

temporary reading and advertising signs, temporary, easily restored removable guard-rails, fencing, traffic or crowd control posts or supports, sports or playground fixtures such as for goal posts at specific places when a given sports code is "in season" and replacement by a cover otherwise, playground fixtures such as of the type based on vertical pipes rising out of the ground—allowing reconfiguration from time to time, preventing vehicle access to a space by all but approved vehicles, providing temporary watering stations such as in an orchard during a frosty season, providing removable stock yards for a farm—particularly for the more boisterous animals such as cattle and deer which are likely to "supersede" temporary yards not dug into the ground.

Finally, it will be understood that the scope of this invention as described and/or illustrated herein is not limited to the specified embodiments. Those of skill will appreciate that various modifications, additions, known equivalents, and substitutions are possible without departing from the scope and spirit of the invention as set forth.

What is claimed is:

1. An anchor for fastening an elongate member into a substrate, said elongate member having a foot of substantially constant cross-section, characterised in that said anchor comprises:

at least one elongate collet having an inward face shaped to fit along and around a section of said foot;

and an elongate housing having an internal cavity shaped and dimensioned to house said at least one collet and said foot in combination;

wherein said at least one collet each has a top end and a bottom end, said top end and bottom end being spaced to be positionable near a top and bottom of said internal cavity in said housing, and an outward face which tapers inwardly from said top end towards said bottom end in a first tapered portion near said top end and in a second tapered portion near said bottom end, and wherein said internal cavity of the housing tapers inwardly in a corresponding first and second portion, and wherein said outward face of each said collet is untapered between said first tapered portion and said second tapered portion and said second tapered portion;

whereby in use downward pressure on a said collet can create wedging contact between said outward face and said housing near said top end and near said bottom end and wherein substantially no wedging contact occurs between the collet and the housing between said first and second tapered portions.

2. The anchor as claimed in claim 1, wherein said at least one collet and said housing are formed from a resilient plastics material.

3. The anchor as claimed in claim 1, wherein the anchor includes two collets configured to form substantially complementary parts of a sleeve that is shaped and arranged to surround said foot.

4. The anchor as claimed in claim 1, wherein said at least one collet includes an outwardly projecting flange at said top end.

5. The anchor as claimed in claim 4, wherein said housing includes a collar shaped and arranged to house said flange.

6. The anchor as claimed in claim 5, further including a cap, dimensioned and adapted to engage into said collar.

7. The anchor as claimed in claim 6, wherein said cap is annular, and is dimensioned and arranged to fit around said elongate member.

8. The anchor as claimed in claim 4, further including a collet-removing tool comprised of a handle, a fulcrum, and a crescent-shaped head extending transversely relative to said handle and offset relative to said fulcrum, whereby the tips of said crescent-shaped head can be engaged under said projecting flange at the top end of a said collet.

9. The anchor as claimed in claim 8, wherein said tool further includes a bearing block adapted and arranged to fit under said fulcrum.

10. The anchor as claimed in claim 8, wherein said head is pivotally mounted with respect to said handle and said fulcrum.

11. A method for removing an elongate member fastened in a substrate using the anchor of claim 8, comprising the steps of:

engaging the tips of said crescent-shaped head of the tool under a projecting flange of a collet;

applying pressure to said handle of the tool, to lift said collet with leverage against said fulcrum;

removing said collet;

and removing said elongate member.

12. The anchor as claimed in claim 1, wherein a said collet includes a longitudinal slot extending downwardly from said top end; and wherein the anchor further includes a key shaped and dimensioned to fit into said slot, and configured to engage between said foot and said housing through said collet.

13. The anchor as claimed in claim 12, wherein said housing further includes a recess and a metal backing plate configured to be engaged by said key.

14. The anchor as claimed in claim 12, wherein said key comprises a flat blade having an edge arranged to engage with said foot, said edge being concave in cross-section.

15. The anchor as claimed in claim 12 wherein said key includes a flange at a top end thereof, substantially corresponding in size and shape with a section of said slotted collet.

16. The anchor as claimed in claim 1, wherein said inward face of each said collet includes a plurality of transverse ribs near said top end and near said bottom end.

17. The anchor as claimed in claim 1, wherein said housing includes at least one aperture at or near said bottom end, dimensioned and arranged to admit electrical wiring.

18. The anchor as claimed in claim 1, wherein said housing includes at least one frangible membrane, dimensioned and arranged to admit electrical wiring.

19. The anchor as claimed in claim 1, wherein said housing includes at least one longitudinal rib on a wall of said internal cavity, adapted and arranged to key with said at least one collet.

20. The anchor as claimed in claim 1, wherein one of said foot and said housing includes a transversely projecting pin, and the other includes a transversely extending aperture therein shaped and arranged to engage on said pin, whereby in use downward pressure on a said collet can press said pin into engagement with said aperture, such that longitudinal movement of said foot relative to said housing is prevented by said pin.

21. The anchor as claimed in claim 1, wherein said housing includes one or more projections on an external surface thereof, to engage with said substrate.

22. A method for fastening an elongate member in a substrate using the anchor of claim 1, comprising the steps of:

setting a said housing into a hole in said substrate, using a settable fluid construction material such as concrete;

inserting a foot of said elongate member into the internal cavity of said housing;

inserting at least one said collet alongside said foot into the internal cavity of said housing;

applying downward pressure on said at least one collet to create wedging contact between said collet and said housing near the top end and near the bottom end, and wherein substantially no wedging contact occurs between the collet and the housing between said first and second tapered portions.

23. A method as claimed in claim 22, wherein a said collect includes a longitudinal slot extending downwardly from said top end, and said anchor further includes a key shaped and dimensioned to fit into said slot;

further including the step of fitting said key into said longitudinal slot to engage between said foot and said housing through said collet.

24. A method as claimed in claim 22, further including the step of applying an annular cover over said housing around said elongate member, and engaging said cover in a collar on said housing.

* * * * *

UNITED STATES PATENT AND TRADEMARK OFFICE

CERTIFICATE OF CORRECTION

PATENT NO. : 7,954,289 B2
APPLICATION NO. : 12/129620
DATED : June 7, 2011
INVENTOR(S) : Evans It is certified that error appears in the above-identified patent and that said Letters Patent is hereby corrected as shown below:

- Column 10, Line 38, please delete “Pines” and insert --Pipes--.
- Column 11, Line 25, please delete “iron,” and insert --iron.--.
- Column 12, Line 8-9 (Approx.), In Claim 1, please delete “and said second tapered portion and said second tapered portion;” and insert --and said second tapered portion;--.

Signed and Sealed this
Twenty-second Day of November, 2011

David J. Kappos

David J. Kappos
*Director of the United States Patent and Trademark Office*